US005260515A

United States Patent [19]

Braun, Jr.

[11] Patent Number: 5,260,515

[45] Date of Patent: Nov. 9, 1993

[54] TWIST-ON WIRE CONNECTOR

[76] Inventor: Francis J. Braun, Jr., 204 2nd Ave., East Northport, N.Y. 11731

[21] Appl. No.: 889,193

[22] Filed: May 28, 1992

[51] Int. Cl.[5] ..... H01R 4/22

[52] U.S. Cl. ..... 174/87; 174/845; 174/203

[58] Field of Search ..... 174/87, 845, 203

[56] References Cited

U.S. PATENT DOCUMENTS

| | | | |
|---|---|---|---|
| 1,678,752 | 7/1928 | Van Gelderen | 174/87 |
| 3,001,002 | 9/1961 | Schinske | 174/87 |
| 3,497,607 | 2/1970 | Swanson | 174/87 |
| 3,558,800 | 1/1971 | Wallis | 174/87 |
| 4,288,657 | 9/1981 | Swanson | 174/87 |
| 4,473,715 | 9/1984 | Beinhaur et al. | 174/87 |
| 4,740,656 | 4/1988 | Rich | 174/87 |
| 5,023,401 | 6/1991 | Clifton | 174/87 |

*Primary Examiner*—Morris H. Nimmo
*Attorney, Agent, or Firm*—Galgano & Belkin

[57] ABSTRACT

A twist-on wire connector for connecting the ends of a plurality of wires together, includes a hollow, cup-shaped housing having an inner cavity with an opening at one end thereof and a closed end wall at the other end thereof and a coiled spring received in the housing and defining a wire-receiving first end generally adjacent to the opening of the housing and a constricted second end generally adjacent to the housing closed end wall. The coiled spring is in the form of at least a double helix so as to define at least a dual coil spring having a dual leading edge which facilitates quick twist-on of the wires.

9 Claims, 1 Drawing Sheet

TWIST-ON WIRE CONNECTOR

BACKGROUND OF THE INVENTION

1. Field of the Invention

The present invention relates to a twist-on type wire connector. More particularly, it relates to such a connector which includes a tapered, coiled insert spring which serves as a fastening element contained within a surrounding insulating shell.

2. The Prior Art

Wire connectors of various types are well-known and have been widely used in the industry. (See, for example, U.S. Pat. No. 4,473,715, to Beinhaur et al; U.S. Pat. No. 3,558,800, to Wallis et al: U.S. Pat. No. 4,740,656, to Rich; and U.S. Pat. No. 4,288,657, to Swanson.) These wire connectors are typically comprised of a thermoplastic shell having an interior, at least partially threaded cavity for receiving and retaining a single spring fastening element. The wire connector is typically used by electricians for connecting the stripped ends of a plurality of insulated wires together. Initially, the stripped ends of the wires are twisted together and they, in turn, are inserted into the cavity of the shell, and the user then twists the shell onto the ends of the wires, where they are grabbed and fastened by the coiled spring. One of the main problems with the present wire connectors is the amount of time necessary to effect full engagement of the bundle of insulated wires in the wire connector so that the same is fully received within the wire connector. This is because to achieve full insertion, the wires must be stepwise and threadably inserted into the single spiral coil spring of the wire connector shell by time-consuming rotation of the wire connector.

SUMMARY OF THE INVENTION

Accordingly, it is an object of the present invention to provide a novel twist-on wire connector which greatly facilitates and shortens the time necessary for connecting the ends of a plurality of wires together.

It is a more particular object of the present invention to provide such a novel twist-on wire connector which is relatively simple in design, economical to fabricate and universally adaptable to a variety of wire connector designs.

Certain of the foregoing and related objects are readily attained, according to the present invention, by the provision of a twist-on wire connector for connecting the ends of a plurality of wires together, which includes a hollow cup-shaped housing having an inner cavity having an opening at one end thereof and a closed end wall at the other end thereof. A coiled spring is received in the housing and defines a wire-receiving first end generally adjacent to the opening of the housing and a constricted second end generally adjacent to the housing closed end wall. The coiled spring is in the form of at least a double helix so as to define at least a dual coil spring having a dual leading edge which facilitates quick twist-on of the wires.

The coiled spring may be made of separate springs positioned together in an overlapping manner, so as to define the double helix having a dual leading edge. Alternatively, the coiled spring may be made from wire in the form of a double strand wound in a helical fashion.

Preferably, the double helix of the spring decreases in diameter from the first end to the second end thereof.

Most desirably, the coiled spring is composed of windings having a polygonal cross-section and, in particular, a square-shaped cross-section. In a particularly preferred embodiment of the present invention, the housing is made of plastic and includes a pair of external, wing-like members extending from opposite sides of the outer surface of the housing. Most advantageously, the housing also has a plurality of helically-directed threads found in the inner cavity on which at least a portion of the spring may be wound.

BRIEF DESCRIPTION OF THE DRAWING

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF THE PREFERRED EMBODIMENTS

Figure 2:
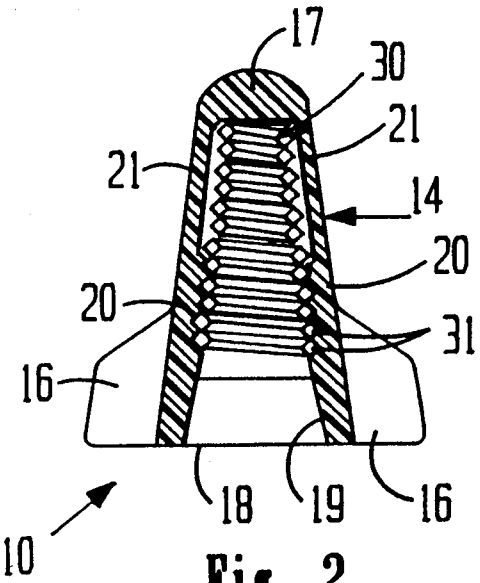
FIG. 2 is a cross-sectional view of the twist-on wire connector embodying the present invention.
Figure 1:
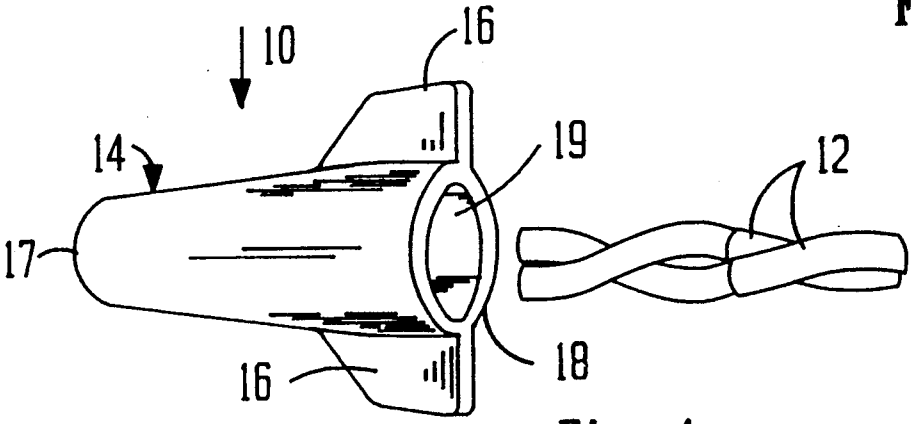
FIG. 1 is a perspective view of a novel twist-on wire connector embodying the present invention, also showing the twisted, stripped ends of a plurality of insulated wires being directed towards the cavity thereof.

Referring now to FIGS. 1 and 2, therein shown is a novel wire connector embodying the present invention, generally designated by reference numeral 10, which is used for connecting the ends of a plurality of wires, preferably the stripped ends of a plurality of insulated wires 12 together. Wire connector 10 includes a thermoplastic shell or housing, generally designated 14, having a pair of spaced-apart, angled wings 16 to provide a greater gripping area for the user. Shell 14 has a generally tapered, inverted, cup-shaped conical profile having a closed upper end 17 and a flared outwardly-opening lower end 18, which defines an opening into the interior cavity 19. Spaced inwardly from the opening of the lower end 18 is a threaded section 20, which is in the form of a plurality of right-angled helical threads. This leads to a straight- tapered section 21, the purposes of both of which will be described in greater detail hereinafter.

Fitted into cavity 19 of shell 14 is an upwardly tapered, metal coil spring, generally designated 30, which is in the form of a double-helix so as to define a dual coil having a dual leading edge 31. The double helix coil spring 30 preferably has a square-shaped polygonal cross-section and has a tapered configuration corresponding to the tapered configuration of housing 14. The lower end portion of the double helix coil spring 30 is threadably received in the threaded section 20 of housing 14, and the upper end portion is received in the upper straight tapered section 21, slightly spaced therefrom. The upper end of spring 30 abuts closed end wall 17. Due to the fact that the straight tapered portion 21 is unthreaded, the coiled spring is allowed to expand freely and accept a wider variety of wire combinations. The square wire configuration of the spring grips the conductors tightly for secure connections with maximum surface-to-surface contact. The flared opening allows for easy wire insertion.

Figure 4:
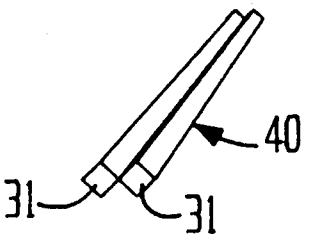
FIG. 4 is a perspective view of a double wire strand for forming the double helix spring according to an alternate embodiment of the invention.
Figure 3:
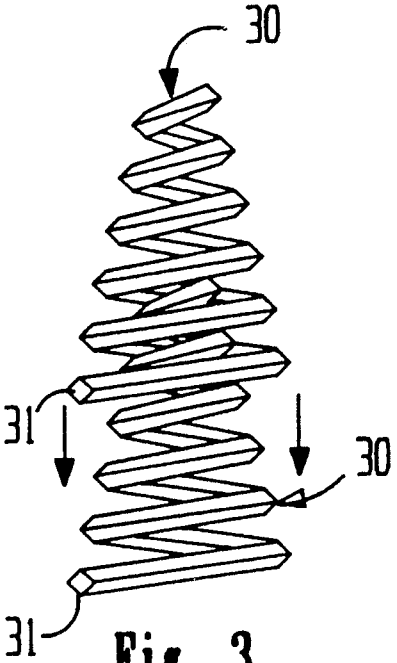
FIG. 3 is a perspective view of one embodiment for fabricating the double-helix spring of the present invention from two coil springs.

FIGS. 3 and 4 illustrate different embodiments for making the double helix coil spring. As shown in FIG. 3, two conventional standard coil tapered springs 30 of the same dimensions may be placed one over the other, by movement in the direction of the arrow shown in FIG. 3, and can then be laterally displaced and aligned so that leading ends 31 and the subsequent windings of springs 30 are disposed adjacent to one another in the manner shown in FIG. 2. Alternatively, as shown in FIG. 4, the spring may be made from a double wire strand 40, which is then wound into the double helix configuration.

In operation, the user simply takes the stripped ends of the twisted together wires and inserts them into the open end 18 of cavity 19 of shell 14 and then turns shell 14, via the wings 16, in a clockwise fashion, so as to twist on the connector 10 onto the wires 12 whereby the wires 12 are inserted into the central opening of the spring 30, where it engages the double leading edge and subsequent windings of the double helix coil, until such time that it typically abuts the closed end 17 of the shell. Due to the fact that the present invention provides a double helix-double threaded design, the connector 10 can be twisted onto the ends of the wire 12 approximately twice as fast (i.e., approximately half the number of complete turns being required) as the standard single coil springs and with the same conductor contact as a single wire style.

Various modifications may be made as will be apparent to those skilled in the art. For example, the wire connector can be made in various dimensions, as is standard in the industry, to accommodate various sized wires. In addition, although the double helix design is preferred, it may be possible to provide a multi-coil design composed of three or more wires and leading edges, although this will also increase, to some extent, the torque necessary to twist on the connector. Furthermore, the inner cavity of the housing may be modified as desired to either hold the coil in place, such as by threads, or to allow for expansion, both possibilities of which are shown in the present drawings. In addition, the wings could be provided with a non-slip or knurled surface for better gripping, or the wings could optionally be removed, as desired.

Accordingly, while only one embodiment of the present invention has been shown and described, it is to be understood that many changes and modifications may be made thereunto without departing from the spirit and scope of the invention as disclosed herein.

What is claimed is:

1. A twist-on wire connector for connecting the ends of a plurality of wires together, comprising:

a hollow, cup-shaped housing having an inner cavity having an opening at one end thereof and a closed end wall at the other end thereof;

a coiled spring received in said housing and defining a wire-receiving first end generally adjacent to the opening of said housing and a constricted second end generally adjacent to said housing closed end wall, said coiled spring being in the form of at least a double helix so as to define at least a dual coil spring having a dual leading edge which facilitates quick twist-on of said wires.

2. The wire connector of claim 1, wherein said coiled spring is made of separate springs positioned together in an overlapping manner, so as to define said double helix having a dual leading edge.

3. The wire connector of claim 1, wherein said coiled spring is made from wire in the form of a double strand wound in a helical fashion so as to define said double helix having a dual leading edge.

4. The wire connector of claim 1, wherein said double helix of said spring decreases in diameter from said first end to said second end thereof.

5. The wire connector of claim 1, wherein said coiled spring is composed of windings having a polygonal cross-section.

6. The wire connector of claim 5, wherein said wire has a square-shaped cross-section.

7. The wire connector of claim 1, wherein said housing is made of plastic.

8. The wire connector of claim 7, wherein said housing includes a pair of external wing-like members extending from opposite sides of said housing.

9. The wire connector of claim 1, wherein said housing has a plurality of helically-directed threads found in said inner cavity on which at least a portion of said spring may be wound so as to maintain the same in a fixed position.

* * * * *